United States Patent [19]

Marass

[11] 4,050,692

[45] Sept. 27, 1977

[54] SHEET FEEDING MACHINE

[75] Inventor: Josef Marass, Seehausen near Murnau, Germany

[73] Assignee: Georg Spiess GmbH, Gersthofen, Germany

[21] Appl. No.: 658,685

[22] Filed: Feb. 17, 1976

Related U.S. Application Data

[63] Continuation-in-part of Ser. No. 531,684, Dec. 11, 1974, abandoned.

[30] Foreign Application Priority Data

July 18, 1974 Germany ..... 2434625

[51] Int. Cl.[2] ..... B65H 5/10

[52] U.S. Cl. ..... 271/267; 192/27; 192/33 R; 214/1 BT; 271/91; 271/99

[58] Field of Search ..... 271/267, 268, 269, 139, 271/140, 84, 85, 266, 256, 132, 99, 91, 136; 214/1 BT; 192/27, 33 R

[56] References Cited

U.S. PATENT DOCUMENTS

| | | | |
|---|---|---|---|
| 1,616,565 | 2/1927 | Andrew | 271/269 |
| 1,999,836 | 4/1935 | Guilbault | 271/99 |
| 2,153,180 | 4/1939 | Fuller et al. | 271/139 X |
| 2,266,587 | 12/1941 | Carlson | 192/27 |
| 2,566,175 | 8/1951 | Danielsson | 271/91 |
| 3,422,757 | 1/1969 | Grobman et al. | 271/139 X |

*Primary Examiner*—Bruce H. Stoner, Jr.
*Attorney, Agent, or Firm*—Webb, Burden, Robinson & Webb

[57] ABSTRACT

A device for feeding sheets to another machine, said device having conveying rollers continuously rotating at the same peripheral speed as the receiving rollers of the fed machine. Gripper devices reciprocate toward and away from the conveying rollers to pick up a sheet and accelerate it to the peripheral speed of the rollers. The gripper devices are disengageably coupled to the conveying rollers to be driven thereby and to be actuated in time sequence with the fed machine.

6 Claims, 6 Drawing Figures

SHEET FEEDING MACHINE

RELATED APPLICATION

This application is a continuation-in-part of U.S. Pat. application Ser. No. 531,684 filed Dec. 11, 1974, now abandoned.

This invention relates to a sheet feeding machine, for example, a device for feeding sheets of paper to a laminating coating machine, a varnishing machine and other like machines for conveying or processing individual sheets.

Prior feeding devices consist of a conveying roller and a cooperating counter roller which rotate continuously at the same peripheral speed as the rollers of the processing device being fed. A sheet is delivered to the conveying roller and counter roller by a reciprocating gripper device driven to accelerate the sheet to the peripheral speed of the conveying roller. Every time a sheet is fed by the prior art feeding device, there must be an idle stroke while the gripper device returns to a starting position where it can pick up a new sheet.

It is an advantage of this invention to eliminate the prior art acceleration drive for the grippers and to increase the efficiency of the feeder by eliminating the idle stroke.

Briefly, the advantages of this invention are accomplished by driving a gripper device from the conveying rollers and providing a disengageable coupling or clutch means between the gripper device and the conveying rollers which may actuate the gripper device in time with the desired sheet feeding sequence controlled by the processing device or fed machine. For example, the gripper device may be engaged and disengaged by a clutch actuated by a cam follower responding to a single revolution of a cam. The cam shaft turns in timed relationship to the processing or fed machine. According to another embodiment, the clutch may be engaged and disengaged electromagnetically.

Preferably, the gripper device comprises two sets of reciprocating suction cups which alternately move toward and away from the conveying rollers.

Further features and other objects and advantages of this invention will become clear from reading the following detailed description with reference to the drawings in which.

Figure 1:
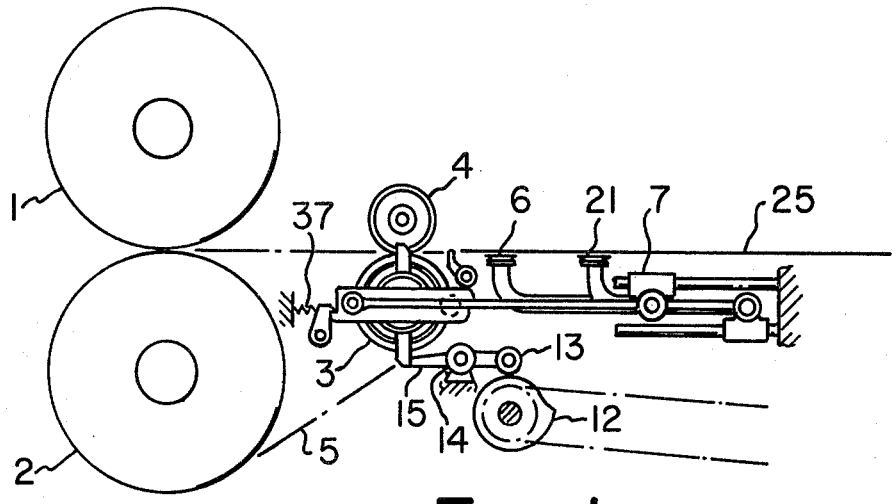
FIG. 1 is a schematic side elevation of one embodiment of this invention.

A sheet processing device (e.g., a coating or pasting device) for which feeders according to this invention deliver individual sheets may comprise continuously rotating entry roller 1 with counter roller 2. Disposed parallel thereto are the conveying roller 3 and counter roller 4 of the feeding device. The conveying roller and counter roller are continuously driven by a drive 5 at the same peripheral speed as the entry rollers 1 and 2.

A gripping device comprises a first set of paper grippers or suction cups 6 secured to a horizontal guided support rod 7. The rod is caused to reciprocate by cranks 8 and 9 which are secured thereto by connecting rods 10. The shaft to which the cranks 8 and 9 are attached can be engaged to rotate with the continuously rotating conveying roller 3 by clutch 11. The clutch is engaged and disengaged in time with the sheet sequence by cam 12 which may be driven by acting upon the cam follower provided with roller 13, cam follower pivot shaft 14 and actuating end 15.

Figure 2:
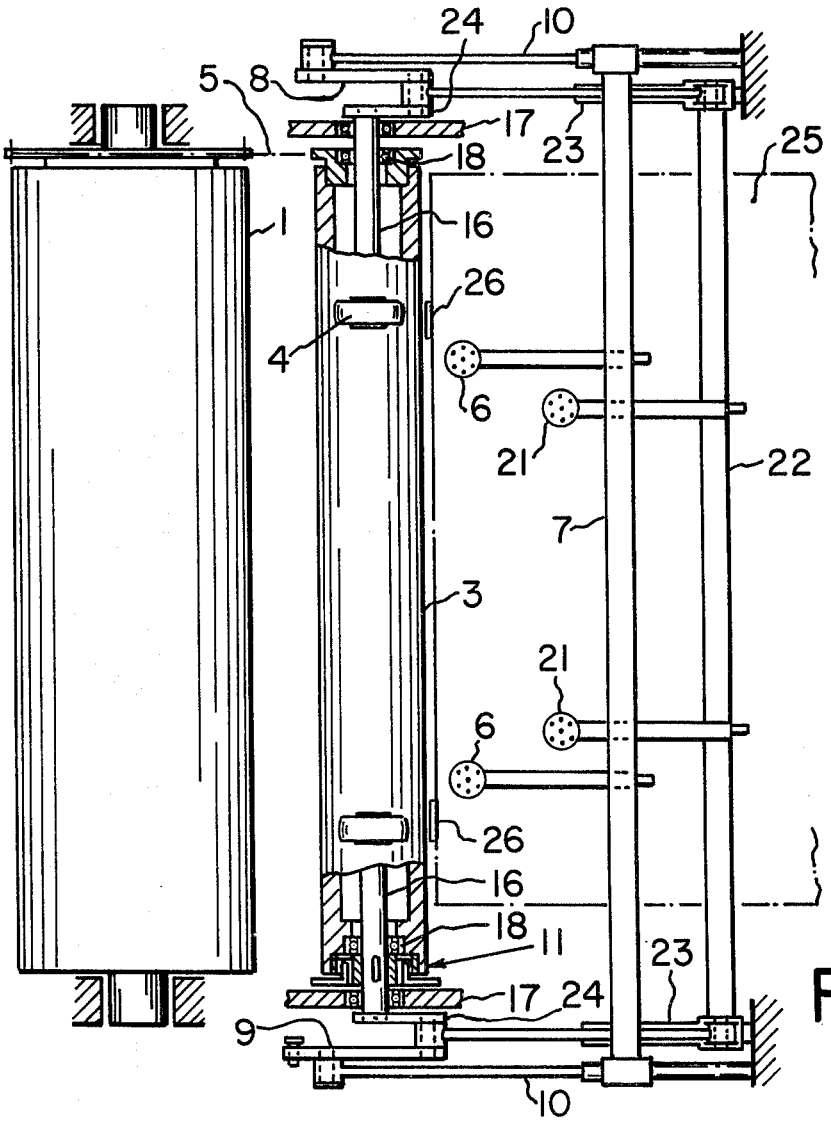
FIG. 2 is a schematic top plan view of one embodiment of this invention.

As shown in FIG. 2, the cranks 8 and 9 are connected to shaft 16 which is journalled in a frame 17 and conveying roller 3 is freely pivotable on shaft 16 via roller bearings 18.

Figure 5:
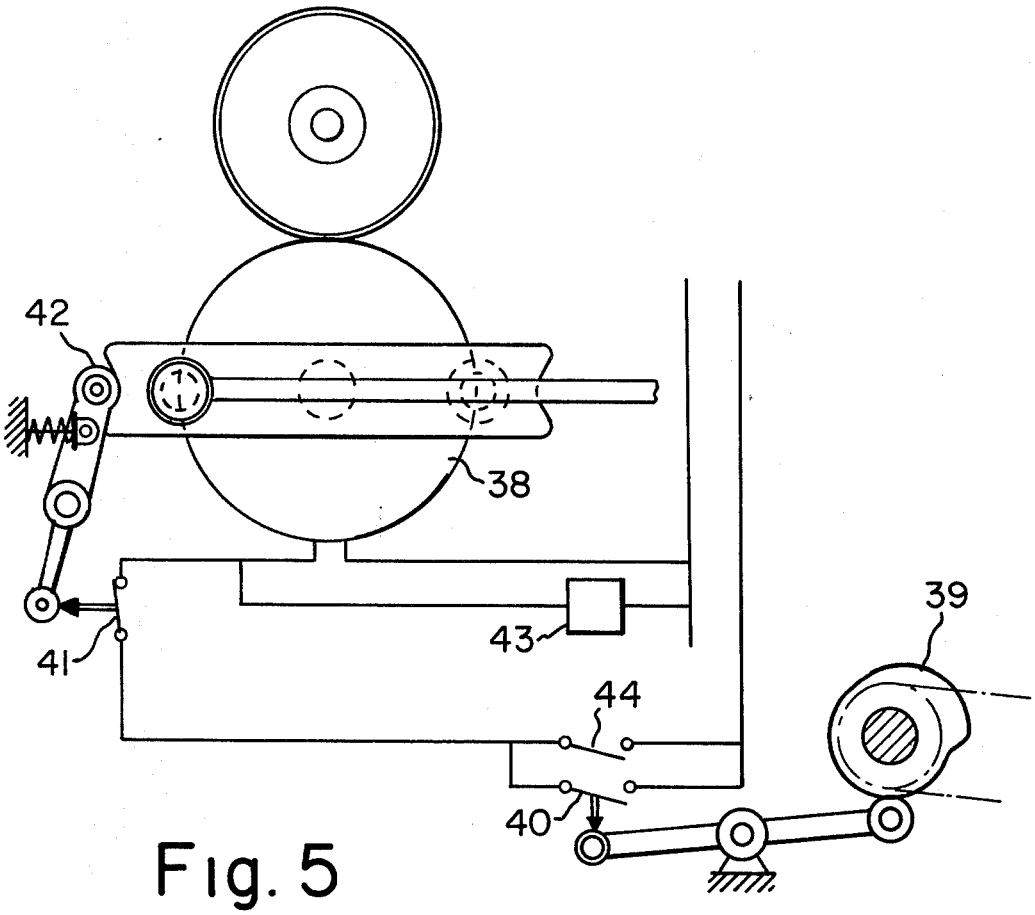
FIG. 5 is a schematic view of an electromagnetic clutch suitable for use in the invention.
Figure 6:
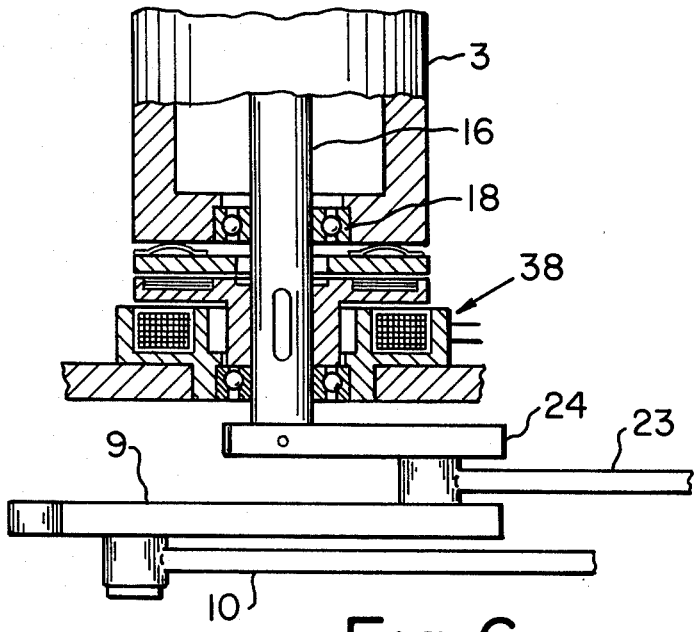
FIG. 6 is a schematic top plan view of the clutch of FIG. 5 in the sheet feeding machine according to the invention.

The rotary motion of the conveying roller 3 may be transmitted to shaft 16 by engagement of the clutch 11 to initiate motion of the sheet adhering on suction cups 6 via cranks 8, 9. The structure and operation of the clutch 11 is explained in detail hereinafter with respect to a roller clutch 19 (FIGS. 3 and 4) and an electromagnetic clutch 20 (FIGS. 5 and 6).

In the embodiment shown in FIGS. 1 and 2 of the drawings, the gripper devices comprise two sets of reciprocating suction cups (6, 21) which alternately move toward and away from the conveying rollers. Suction cups 21 of the second group are secured to support rod 22 which is reciprocated by connection rods 23 secured to crank pins 24. Due to the alternate engagement of the two sets of gripper devices the operating speed of the feeder is substantially increased compared with prior art devices in which the conveying means must execute a complete stroke for feeding each sheet.

The connecting rod 23 for support rod 22 and suction cups 21 are shown in FIG. 2 in the rearward dead center position with the clutch disengaged. Sheet 25, which abuts against the front stops 26 in this position, is picked up by suction cups 21 after front stops 26 have been lowered. When the actuating end 15 of the cam follower is swung out, the clutch is engaged and the crank is driven. Consequently, the sheet is set in motion slowly and after the crank has rotated approximately 80° it obtains the full peripheral speed of conveying roller 3. The cam follower actuating end 15 and the clutch 11 may comprise a ratchet which permits the crank shaft to turn through about 180° during which one sheet is fed to the rollers.

Means such as cams not shown, force the suction cups against a sheet when the connecting rods are in the most rearward position and release the suction cups from the sheet when the connecting pin of the rod is at its top most position. The sheets are spaced from the rollers about one-fourth turn of the roller such that they will not be picked up by the rollers until they have been accelerated to about the peripheral speed of the rollers. In this way, at about the time the sheet reaches the peripheral speed, the suction cups are disengaged.

Figure 3:
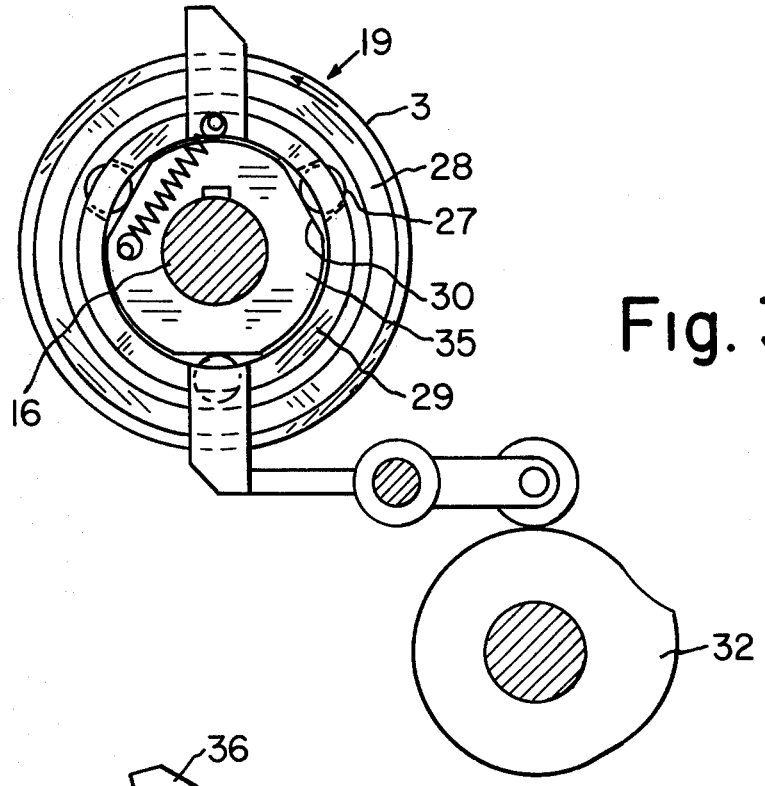
FIG. 3 is a side elevation of a roller clutch, in disengaged position, suitable for use in the invention.

In FIG. 3, a roller clutch 19 suitable for use in the machine is shown in the disengaged position, that is, with clamp elements 27 of the clutch out of engagement wih an outer ring 28 which is rigidly connected to the conveying roller 3. The clamp elements 27 are guided in a cage 29 and returned about in the center of the clamping faces 30 arranged on an inner ring, rigidly connected to the shaft 16.

Figure 4:
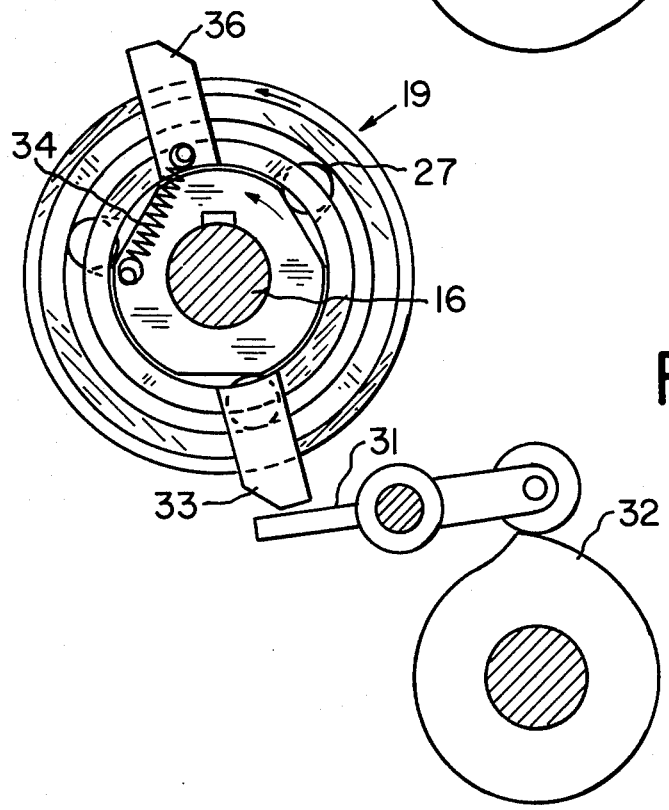
FIG. 4 is a side elevation of the roller clutch of FIG. 3 in engaged position.

When, as shown in FIG. 4, a lever 31 is pivoted by the cam 32 controlled according to the time sequence of the sheet feeding machine, a stop 33 arranged on the cage 29 is released from lever 31. Consequently, tension spring 34 can rotate the cage 29 relative to the inner ring 35 establishing frictional connection between the outer ring 28 and inner ring 35 by means of the clamp elements 27. Thus, a drive connection is made between conveying roller 3 and shaft 16 with cranks 8, 9.

Shaft 16 is stopped after a rotation of 180° when a second stop 36 arranged on cage 29 runs up against lever 31 which has resumed its basic position shown in FIG. 3. When cage 29 is stopped (which is the equivalent of a clockwise motion of the still rotating inner ring 35), the clamp elements 27 are disengaged and take the position shown in FIG. 3. The tension spring 34 then returns the cranks 8 and 9, which tend to continue rotation due to their proper motional energy, into a final position precisely determined by ratchet 37 (shown in FIG. 1) which correspondingly limits the displacement of the inner ring 35 by engaging cranks 8, 9.

An electromagnetic clutch 38, as shown in FIGS. 5 and 6, may be used instead of a roller clutch. The pulse for engaging the clutch 38 is derived from a cam 39 which actuates a switch 40. In the same manner, the clutch is disengaged and thus the shaft 16 stopped after a rotation of 180° by a correspondingly arranged limit switch 41. The setting of the final position is effected by a roller catch 42 (see FIG. 5). Relay switch 43 has a lock type contact 44.

Having thus described my invention with detail and particularity as required by the Patent Laws, what is desired to be protected by Letters Patent is set forth in the following claims.

I claim:

1. In a device for feeding sheets to a fed machine, said device having stationary conveying rollers that rotate continuously at the same peripheral speed as receiving rollers of the fed machine and gripper devices which reciprocate toward and away from the conveying rollers, the improvement comprising:

A. crank means for driving the gripper devices from the conveying rollers in a reciprocating motion such that the gripper devices accelerate said sheets to about the peripheral speed of the conveying rollers; and B. clutch means connected between the continuously rotating conveying rollers and the crank means for the reciprocating gripper devices for engaging said crank means in time sequence with said fed machine, said clutch means being actuated in said time sequence by a rotating cam driven in timed relationship with said fed machine and a cam follower having an end for contacting the rotating cam and an actuating end for mechanically actuating the clutch means, said cam follower being pivoted between said ends.

2. The improvement set forth in claim 1 in which the clutch means is a roller clutch.

3. The improvement set forth in claim 1 in which the clutch means is an electromagnetic clutch.

4. The improvement set forth in claim 1 wherein there are two sets of said gripper devices which alternately move toward and away from said conveying rollers, said sets of gripper devices being driven by a double lever crank.

5. The improvement set forth in claim 1 wherein said cam follower acts as a ratcheting mechanism for the clutch means.

6. The improvement as set forth in claim 1 wherein the gripper devices comprise suction cups.

* * * * *